US009850777B2

(12) United States Patent
Uesugi

(10) Patent No.: US 9,850,777 B2
(45) Date of Patent: Dec. 26, 2017

(54) TURBOCHARGERS

(71) Applicant: KABUSHIKI KAISHA TOYOTA JIDOSHOKKI, Kariya-shi, Aichi-ken (JP)

(72) Inventor: Tsuyoshi Uesugi, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 909 days.

(21) Appl. No.: 14/164,800

(22) Filed: Jan. 27, 2014

(65) Prior Publication Data

US 2014/0212277 A1 Jul. 31, 2014

(30) Foreign Application Priority Data

Jan. 29, 2013 (JP) ..... 2013-014197

(51) Int. Cl.
*F01D 17/14* (2006.01)
*F01D 25/14* (2006.01)
*F01D 17/16* (2006.01)

(52) U.S. Cl.
CPC ..... *F01D 17/145* (2013.01); *F01D 17/165* (2013.01); *F01D 25/14* (2013.01); *F01D 25/145* (2013.01); *F05D 2220/40* (2013.01)

(58) Field of Classification Search
CPC .... F01D 17/165; F01D 17/141; F01D 17/145; F01D 25/14; F01D 25/145
See application file for complete search history.

(56) References Cited

U.S. PATENT DOCUMENTS 5,605,045 A * 2/1997 Halimi ..... F01D 5/085 310/52
6,553,762 B2 * 4/2003 Loffler ..... F01D 9/026 415/203

(Continued)

FOREIGN PATENT DOCUMENTS

DE 10352960 A1 8/2005
DE 102009010311 A1 8/2010

(Continued)

OTHER PUBLICATIONS

English translation of a communication dated Mar. 13, 2015, issued by the State Intellectual Property Office of P.R. China in counterpart Chinese application No. 201410042155.1.

(Continued)

*Primary Examiner* — Kenneth Bomberg
*Assistant Examiner* — Hoon Choi
(74) *Attorney, Agent, or Firm* — Sughrue Mion, PLLC

(57) ABSTRACT

Embodiments of the present invention may include a turbocharger having a turbine, a turbine housing, a variable valve, a first plate, a second plate and a heat shield member. The turbine housing accommodates the turbine and has a flow path. The variable valve rotates about each pivot member provided thereon, thereby adjusting the flow velocity of fluid guided from the flow path to the turbine. The first plate supports one end of each pivot member, and defines the flow path. The second plate supports the other end of each pivot member or the variable valves, and defines the flow path. The heat shield member covers a wall surface of the turbine housing, and defines the flow path.

7 Claims, 3 Drawing Sheets

(56) References Cited

U.S. PATENT DOCUMENTS

| | | | | |
|---|---|---|---|---|
| 7,198,459 | B2 * | 4/2007 | Grussmann | F01D 9/026 415/134 |
| 7,797,936 | B2 * | 9/2010 | Hayashi | F01D 25/16 411/395 |
| 8,418,458 | B2 * | 4/2013 | Williams | F01D 17/165 415/112 |
| 8,961,122 | B2 * | 2/2015 | Tabata | F01D 25/24 415/204 |
| 2005/0133012 | A1 | 6/2005 | Grussmann et al. | |
| 2009/0301082 | A1 * | 12/2009 | Lombard | F01D 17/143 60/602 |
| 2010/0180592 | A1 * | 7/2010 | Williams | F01D 17/165 60/602 |
| 2011/0120124 | A1 * | 5/2011 | Czerwinski | F01D 17/165 60/605.1 |
| 2011/0252775 | A1 * | 10/2011 | Joergl | F01D 25/145 60/321 |

FOREIGN PATENT DOCUMENTS

| | | | | |
|---|---|---|---|---|
| DE | 102009054403 | A1 | 5/2011 | |
| JP | 58085094 | | 6/1984 | |
| JP | 61-192519 | U | 11/1986 | |
| JP | 6240232 | | 3/1987 | |
| JP | 63-183432 | U | 11/1988 | |
| JP | 2000-257436 | A | 9/2000 | |
| JP | 2007231934 | A | 9/2007 | |
| JP | 2008128065 | A | 6/2008 | |
| JP | 2011-247189 | A | 12/2011 | |
| WO | WO 2012147161 | A1 * | 11/2012 | F01D 25/24 |

OTHER PUBLICATIONS

Communication dated Nov. 3, 2014, issued by the German Patent Office in counterpart Application No. 102014200973.1.

Communication dated Dec. 16, 2014, issued by the Japanese Patent Office in counterpart Application No. 2013014197.

* cited by examiner

TURBOCHARGERS

This application claims priority to Japanese patent application serial number 2013-14197, the contents of which are incorporated herein by reference.

BACKGROUND OF THE INVENTION

Field of the Invention

Embodiments of the present invention relate to a turbocharger.

Description of the Related Art

A turbocharger is employed, for example, in an internal combustion engine mounted in a vehicle. In the conventional turbocharger, the energy of the exhaust gas of the internal combustion engine is recovered by a turbine. An impeller (compressor) connected to the turbine by a shaft is rotated by the recovered energy. Intake air is supercharged to the internal combustion engine by the rotating impeller. This helps to enhance the intake efficiency and to achieve an improvement in terms of output and fuel efficiency.

A flow path for the exhaust gas is formed in a turbine housing accommodating the turbine. An exhaust gas at a very high temperature (e.g., 800° C. or more) directly contacts the turbine housing. Thus, the turbine housing requires a very high heat resistance. Forming the turbine housing by using a material having a very high heat resistance will result in an increase in the cost of the turbine housing. Forming the turbine housing by using a material having a lower heat resistance and enhancing the cooling capacity of the turbine housing will result in an increase in loss of the energy of the exhaust gas. This will result in the deterioration of intake efficiency, which means this structure is rather undesirable.

Japanese Laid-Open Patent Publication No. 2011-247189 discloses a variable capacity type supercharger having a variable valve. The supercharger has a bearing housing adjacent to the turbine housing. Between the bearing housing and the turbine, there is provided a heat shield plate configured to shield the heat of the exhaust gas supplied to the bearing housing.

Japanese Laid-Open Utility Model Publication No. 61-192519 discloses a variable turbine nozzle type supercharger having a variable valve. The supercharger has a scroll chamber for guiding the exhaust gas to the turbine, and a bearing housing adjacent to the turbine housing. Between the scroll chamber and the bearing housing, there is provided a heat shield plate configured to shield the heat of the exhaust gas supplied to the bearing housing.

Japanese Laid-Open Patent Publication No. 2000-257436 discloses a turbine housing for use in a turbocharger which has a variable valve. The turbine housing has an inner end surface in close proximity to a movable vane corresponding to a variable valve. The inner end surface is formed through casting of a heat-resisting material which is very resistant to oxidation.

Japanese Laid-Open Utility Model Publication No. 63-183432 discloses a turbine housing for a supercharger that does not have a variable valve. A bearing housing is adjacent to the turbine housing. Between the bearing housing and the turbine, and between the bearing housing and a scroll chamber, there are provided heat shield plates configured to shield the heat of exhaust gas supplied to the bearing housing.

The turbine housings disclosed in Japanese Laid-Open Patent Publication No. 2011-247189, Japanese Laid-Open Utility Model Publication No. 61-192519, and Japanese Laid-Open Patent Publication No. 2000-257436 have a flow path through which the inflow exhaust gas flows until it reaches the turbine. In this route, no heat shielding is created. Thus, to further suppress the energy loss of the exhaust gas, it is necessary for the turbine housing to be formed of a material having a very high heat resistance.

In the prior-art techniques disclosed in Japanese Laid-Open Patent Publication No. 2011-247189 and Japanese Laid-Open Utility Model Publication No. 61-192519, there is newly provided a dedicated heat shield plate for shielding the heat supplied to the bearing housing. As a result, an increase in the number of components is involved.

In the prior-art technique disclosed in Japanese Laid-Open Utility Model Publication No. 63-183432, there are newly provided heat shield plates for shielding heat between the turbine and the bearing housing, and between the scroll chamber and the bearing housing. As a result, an increase in the number of components is involved.

The turbine housing has an inner wall of the flow path through which the inflow exhaust gas flows until it reaches the turbine, and a scroll member covering the inner wall. No particular description regarding the heat resistance of the scroll member is to be found in the document.

The turbocharger with the variable valve has a turbine housing. There is a need in the art for a turbocharger having a turbine housing formed of a lower heat resistance and configured to suppress the energy loss of the inflow fluid.

SUMMARY OF THE INVENTION

According to an aspect of the invention, a turbocharger has a turbine, a turbine housing, a variable valve, a first plate, a second plate and a heat shield member. The turbine is rotated by using energy caused by fluid flowing into the turbocharger. The turbine housing accommodates the turbine and has a flow path for guiding the fluid to the turbine. The variable valve rotates about each pivot member provided thereon, thereby adjusting the flow velocity of the fluid guided from the flow path to the turbine. The first plate supports a first end of each pivot member, and defines the flow path. The second plate supports a second end of each pivot member or the variable valves, and defines the flow path. The heat shield member covers a wall surface of the turbine housing, and defines the flow path. The flow pass is configured such that the fluid flowing into the turbocharger is guided to the turbine through between the first plate and the second plate and the heat shield member.

Thus, in the turbine housing, the fluid is guided to the turbine through the flow path defined by the first plate, the second plate, and the heat shield member. The first plate and the second plate support the pivot members of the variable valves. Thus, it is only the heat shield member that is added in order to define the flow path. The first plate, the second plate and the shield member are endowed with a predetermined heat resistance. Thus, it is possible to suitably block the conduction of heat between the fluid and the turbine housing. The heat shield member partially or fully covers the wall surface of the turbine housing, so that it can block the conduction of heat into the turbine housing. As a result, it is possible to further lower the requisite heat resistance of the material of the turbine housing. Alternatively, there is no need to enhance the capacity to cool the turbine housing. Thus, it is possible to suppress the energy loss of the inflow fluid.

According to another aspect of the invention, the turbocharger may further comprise a rotation shaft of the turbine, a bearing and a bearing housing. The bearing rotatably supports the rotation shaft. The bearing housing accommodates the rotation shaft and the bearing, and is connected to the turbine housing. The heat shield plate has one end portion held between the turbine housing and the bearing housing, and the other end portion held between the turbine housing and the first plate or the second plate.

Thus, the heat shield plate may be fixed to the turbine housing without having to add any special component. The heat shield plate may be fixed to a desired position on the turbine housing due to its simple construction.

According to another aspect of the invention, the turbine housing may comprise a discharge port to which the fluid is guided after rotating the turbine. The turbocharger further may include a discharge port heat shield member. The discharge port heat shield member is configured to cover at least a part of an inner wall of the discharge port. The discharge port heat shield member is preferably of a tubular configuration.

According to another aspect of the invention, the turbine housing may comprise a discharge port to which the fluid is guided after rotating the turbine. The turbocharger may further include a connection pipe connected to the discharge port. The connection pipe may comprise a discharge port heat shield member. The discharge port heat shield member is accommodated in the discharge port. The discharge port heat shield member is configured to cover at least a part of an inner wall of the discharge port. The discharge port heat shield member is preferably of a tubular configuration.

Thus, the heat shielding of the discharge port of the turbine housing may be formed in a simple construction. As a result, it is possible to further lower the heat resistance of the material of the turbine housing.

DETAILED DESCRIPTION OF THE INVENTION

Each of the additional features and teachings disclosed above and below may be utilized separately or in conjunction with other features and teachings to provide improved turbochargers. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful configurations of the present teachings.

Figure 1:
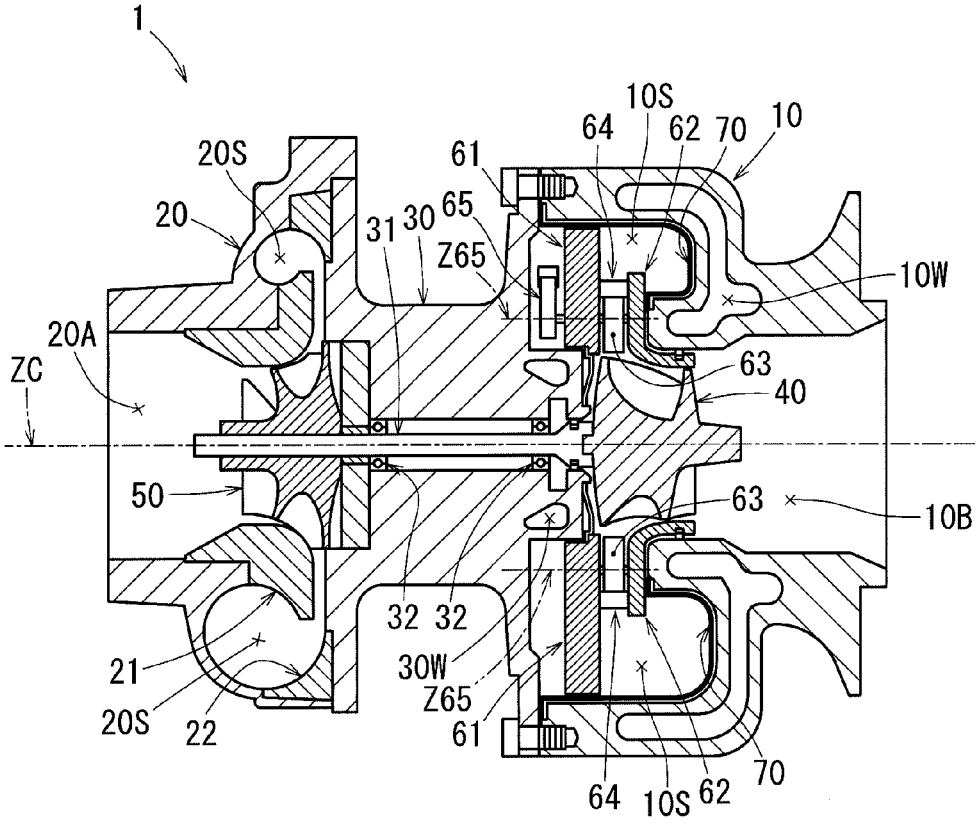
FIG. 1 is an axial cross-sectional view of a turbocharger.

The overall structure of a turbocharger 1 will be described with reference to FIG. 1. The turbocharger is mounted to an internal combustion engine to be mounted, for example, in a vehicle. The turbocharger 1 has three housings: a turbine housing 10, an intake housing 20 and a bearing housing 30.

Inside the bearing housing 30, there is provided a rotation shaft 31 supported by a bearing 32 so as to be rotatable around a rotation axis ZC. A turbine 40 is provided in the turbine housing 10. An impeller 50 is provided in the intake housing 20. The shaft 31 has a first end located in or near the turbine housing 10 and a second end located in or near the intake housing 20. The turbine 40 is fixed to the first end of the shaft 31. The impeller 50 is fixed to the second end of the shaft 31. The turbine 40 and the impeller 50 are connected to each other via the shaft 31. The turbine 40, the shaft 31 and the impeller 50 are integrally rotatable around the rotation axis ZC. A water-cooling jacket 30W for cooling is provided with the bearing housing 30. The water-cooling jacket 30W may be omitted.

The turbine housing 10 has an exhaust inflow port (not shown), a scroll chamber 10S and an exhaust discharge port 10B. The exhaust inflow port is provided in the outer peripheral portion of the scroll chamber 10S, and allows inflow of exhaust gas (fluid) from the internal combustion engine. The scroll chamber 10S guides the inflow exhaust gas to the turbine 40. The exhaust discharge port (discharge port) 10B discharges the exhaust gas that has undergone energy recovery in the turbine 40. The scroll chamber 10S corresponds to the flow path configured to guide the inflow fluid to the section between the first plate 61 and the second plate 62.

Inside the turbine housing 10, there is provided a plurality of variable valves 63, etc. configured to adjust the flow velocity of the exhaust gas guided from the scroll chamber 10S to the turbine 40. Each variable valve 63 rotates about a pivot member provided thereon. The pivot member rotates about a turning axis Z65. One end of the pivot member is supported by the first plate 61. The other end of the pivot member is supported by the second plate 62. A certain distance is maintained between the first plate 61 and a second plate 62 by a spacer 64. There is provided a link member 65 for driving the variable valves 63. The link member 65 is driven by a drive mechanism so as to rotate about the turning axis Z65. A water-cooling jacket 10W for cooling is provided with the turbine housing 10. The water-cooling jacket 10W may be omitted. The other end of the pivot may be omitted and the second plate may support the other end of each variable valve 63.

A heat shield member (plate) 70 is provided inside the turbine housing 10. The intake housing 20 has an intake inflow port 20A, a scroll chamber 20S, and an intake discharge port (not shown). The intake inflow port 20A allows inflow of the intake air taken-in by the internal combustion engine. The scroll chamber 20S forms a flow path for the air caused to flow in and transferred (pressure-fed) by the impeller 50. The intake discharge port is provided in the outer peripheral portion of the scroll chamber 20S, and constitutes an outlet for the transferred (pressure-fed) air. Inside the intake housing 20, there is provided a shroud member 21 and a scroll member 22 forming the scroll chamber 20S.

Exhaust gas at a very high temperature (for example, 800° C. or more) flows from the internal combustion engine into the turbine housing 10. In order to achieve an improvement in terms of heat resistance, the turbine housing 10 is formed of a material containing a component having a high melting point such as nickel in an amount not less than a content corresponding to the desired heat-resistance temperature. Thus, the turbine housing 10 is very expensive. When a water-cooling jacket or the like is formed on the turbine housing to improve cooling capacity, it is possible to reduce the requisite heat resistance of the turbine housing. This helps to reduce the content of nickel or the like of the turbine housing. Improving the cooling capacity, however, results in the energy loss of the exhaust gas. Thus, this construction is rather undesirable.

The turbine housing 10 is provided with the heat-shield plate 70. The heat shield plate 70 appropriately blocks the heat conduction into the turbine housing 10. As a result, it is possible to form the turbine housing 10 of a material having a lower heat resistance without involving an increase in the energy loss of the exhaust gas.

Figure 2:
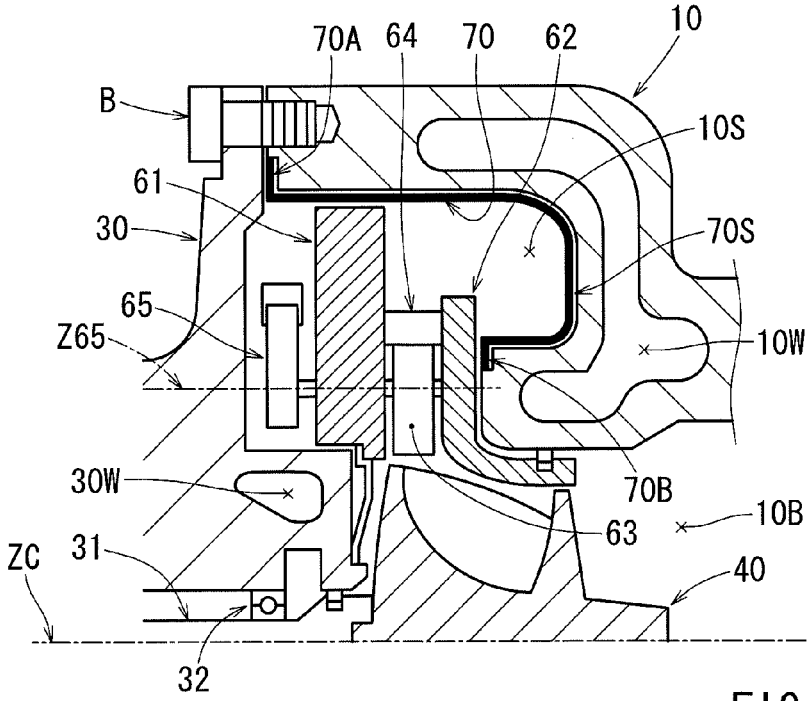
FIG. 2 is an enlarged cross-sectional view of a part of the turbocharger for showing a flow path through which fluid flows to a turbine.

As shown in FIG. 2, the turbine housing 10 accommodates the turbine 40, the first plate 61, the second plate 62, the variable valves 63, the spacer 64, etc. The scroll chamber 10S is formed in the outer periphery of the turbine 40. The high-temperature exhaust gas flowing into the turbine housing 10 is guided from the scroll chamber 10S to the section between the first plate 61 and the second plate 62. The exhaust gas is guided to the turbine 40 via the variable valves 63.

The first plate 61 and the second plate 62 are formed as substantially disc-like plates with their central portions open. The first plate 61 and the second plate 62 rotatably support the pivot members of the variable valves 63. The first plate 61 and the second plate 62 are formed of an austenite type material, such as stainless steel, exhibiting heat resistance with respect to high-temperature exhaust gas. As compared with the volume of the turbine housing 10, the volume of the first plate 61 and of the second plate 62 is sufficiently smaller. Thus, the effect of achieving a reduction in cost is higher than the effect of enhancing the heat resistance of the turbine housing 10.

The exhaust gas flows into the scroll chamber 10S covered with the wall surface of the turbine housing 10. The heat shield plate 70 is formed so as to cover the wall surface. The exhaust gas is guided from the scroll chamber 10S to the section between the first plate 61 and the second plate 62. The heat-shield plate 70 is formed of an austenite type material, such as stainless steel, exhibiting heat resistance with respect to high-temperature exhaust gas.

The turbine housing 10 has a flow path guiding the inflow exhaust gas to the turbine 40. The flow path is formed substantially as a closed space by the heat shield plate 70, the first plate 61, and the second plate 62. Thus, the heat conduction from the exhaust gas to the turbine housing 10 is blocked. This helps to reduce the requisite heat resistance of the turbine housing 10.

As shown in FIG. 2, the bearing housing 30 is connected to the turbine housing 10 by a bolt B or the like. The second plate 62 is provided so as to be substantially in contact with the inner wall of the turbine housing 10. The heat shield plate 70 is fixed inside the turbine housing 10. One edge portion 70A (outer peripheral side edge portion) of the heat shield plate 70 is fixed by being held between the turbine housing 10 and the bearing housing 30. The other edge portion 70B (inner peripheral edge portion) of the heat shield plate 70 is fixed by being held between the turbine housing 10 and the second plate 62.

The plate nearer to the bearing housing 30 will be called the first plate 61, and the plate farther from the bearing housing 30 will be called the second plate 62. It is also possible to call the plate farther from the bearing housing 30 as the first plate, and to call the plate nearer to the bearing housing 30 as the second plate. In this case, the other edge portion 70B of the heat shield plate is fixed by being held between the first plate and the turbine housing. Either the edge portion 70A or the other edge portion 70B may be a free edge that is not held.

As described above, the heat shield plate 70 may be fixed by a simple structure. It is also possible for the heat shield plate 70 to be held in between with an appropriate clearance around it. Due to the clearance, positional deviation resulting from thermal expansion or the like can be appropriately allowed.

The inner wall of the turbine housing 10, situated on the outer peripheral side of the scroll chamber 10S, and the inner wall of the turbine housing 10, situated on the inner peripheral side of the scroll chamber 10S, exhibit surfaces parallel to the rotation axis ZC so as to allow insertion of the heat shield plate 70.

The heat shield plate 70 is a plate formed, for example, of stainless steel and exhibiting a thickness of 0.3 to 0.5 mm. The outer peripheral side inner wall and the inner peripheral side inner wall of the scroll chamber 10S are of a straight configuration parallel to the rotation axis ZC. Thus, the heat shield plate 70 is also of a relatively simple configuration. This makes it very easy to form the heat shield plate 70 through press work.

It is also possible to provide an appropriate gap between the heat shield plate 70 and the inner wall of the turbine housing 10 to form an air layer 70S. The air layer helps to further reduce the heat conducted from the heat shield plate 70 and into the turbine housing 10.

It is also possible to provide a heat insulating member between the turbine housing 10 and the edge portion 70A of the heat shield plate 70, between the bearing housing 30 and the edge portion 70A of the heat shield plate 70, and/or between the turbine housing 10 and the edge portion 70B of the heat shield plate 70.

Figure 3:
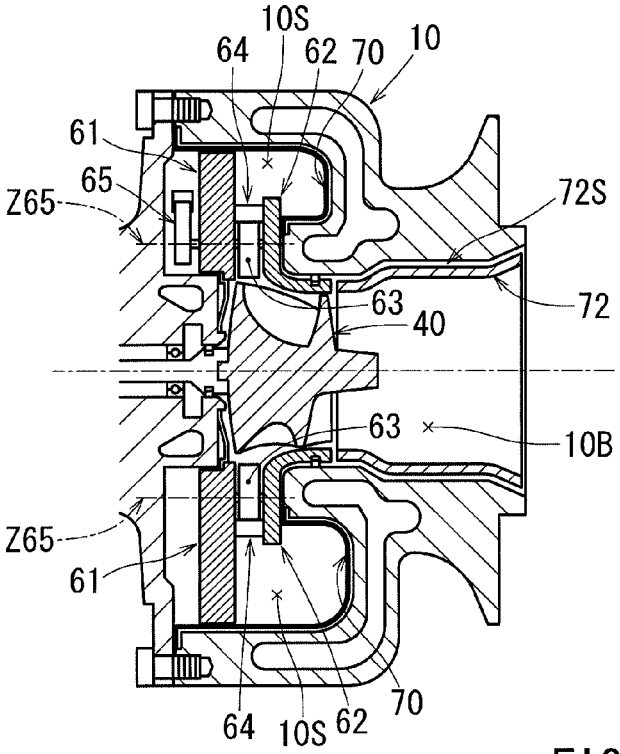
FIG. 3 is a cross-sectional view of a part of the turbocharger having a heat shield member provided around an exit of the turbine.
Figure 4:
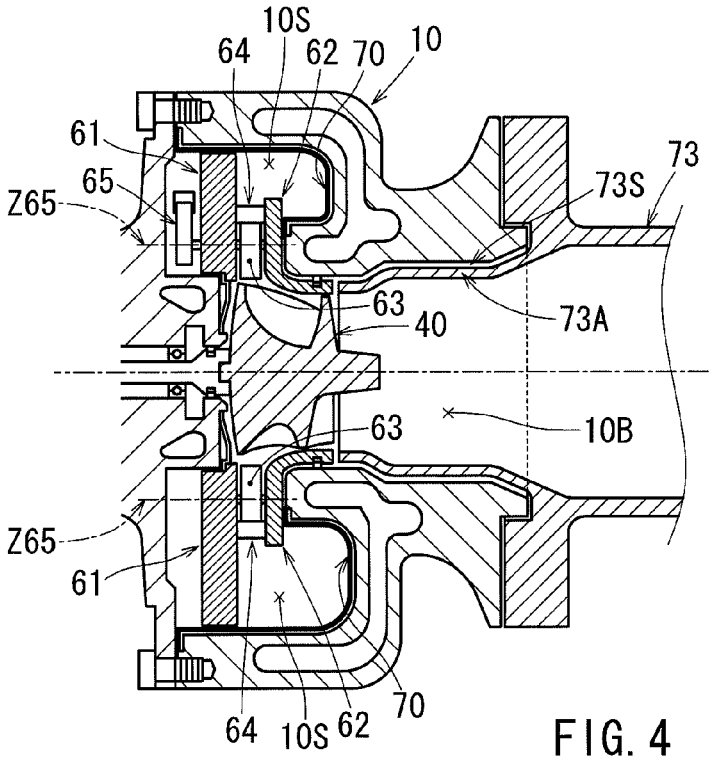
FIG. 4 is a cross-sectional view of a part of the turbocharger having a heat shield member provided around an exit of the turbine.

As shown in FIGS. 3 and 4, it is also possible to provide the exhaust discharge port 10B with a discharge port heat shield means (a discharge port heat shield member 72 and a connection pipe 73). As shown in FIG. 3, the discharge port heat shield member 72 is a structure covering at least a part of the inner wall surface of the exhaust discharge port 10B. The discharge port heat shield member 72 is, for example, of a tubular configuration. The discharge port heat shield member 72 is formed of an austenite type material, such as stainless steel, exhibiting heat resistance with respect to high-temperature exhaust gas. Preferably, the discharge port heat shield member 72 is fixed to the turbine housing 10 such that an air layer 72S is formed between the discharge port heat shield member 72 and the inner wall of the exhaust discharge port 10B.

As shown in FIG. 4, the connection pipe 73 is connected to the exhaust discharge port 10B. The connection pipe 73 has a discharge port heat shield portion (member) 73A covering at least a part of the inner wall surface of the exhaust discharge port 10B. The discharge port heat shield portion 73A is, for example, of a tubular configuration. The discharge port heat shield portion 73A is inserted into the exhaust discharge port 10B. The discharge port heat shield portion 73A is formed of an austenite type material, such as stainless steel, exhibiting heat resistance with respect to high-temperature exhaust gas. Preferably, the discharge port heat shield portion 73A is fixed to the turbine housing 10 such that an air layer 73S is formed between the discharge port heat shield portion 73A and the inner wall of the exhaust discharge port 10B.

The discharge port heat shield means may be configured as shown in FIGS. 3 and 4, or configured with any other construction. For example, the discharge port heat shield means may have a structure extending from the exhaust discharge port side end portion of the second plate 62 shown in FIG. 2 toward the exhaust discharge port. The discharge port heat shield means may be formed, for example, in a tubular configuration.

As described above, the turbine housing has a flow path extending to the turbine. The flow path is formed by the heat shield plate, the first plate and the second plate. Due to this construction, the high-temperature fluid does not contact the inner wall of the turbine housing. The heat conduction from the fluid to the turbine housing is blocked. As a result, the turbine housing may be formed of a material of a further reduced heat resistance. Further, there is no need to enhance the cooling capacity of the turbine housing. Thus, it is possible to suppress the energy loss of the inflow fluid.

The turbine housing requires no component for fixing the heat shield plate in position. Thus, the turbine housing may be a very simple structure. Further, the heat shield plate may be appropriately fixed in position. As a result, it is possible to appropriately suppress vibration of the heat shield plate.

The first plate and the second plate, provided previously, are utilized for heat shielding. Thus, it is possible for the newly added heat shield plate to be smaller.

The inner wall of the turbine housing situated on the outer peripheral side of the scroll chamber and the inner wall of the turbine housing situated on the inner peripheral side thereof are surfaces parallel to the rotation axis ZC. As a result, the heat shield plate may be inserted into the scroll chamber to be of a simpler configuration. This makes it possible to achieve a further improvement in terms of the press workability and assembling property of the heat shield plate.

Preferably, the discharge port heat shield means is provided at the exhaust discharge port of the turbine housing. This helps to further lower the requisite heat resistance of the material of the turbine housing.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. For example, embodiments of the present invention should not be limited to the representative configurations, but may be modified, for example, as described below.

Figure 5:
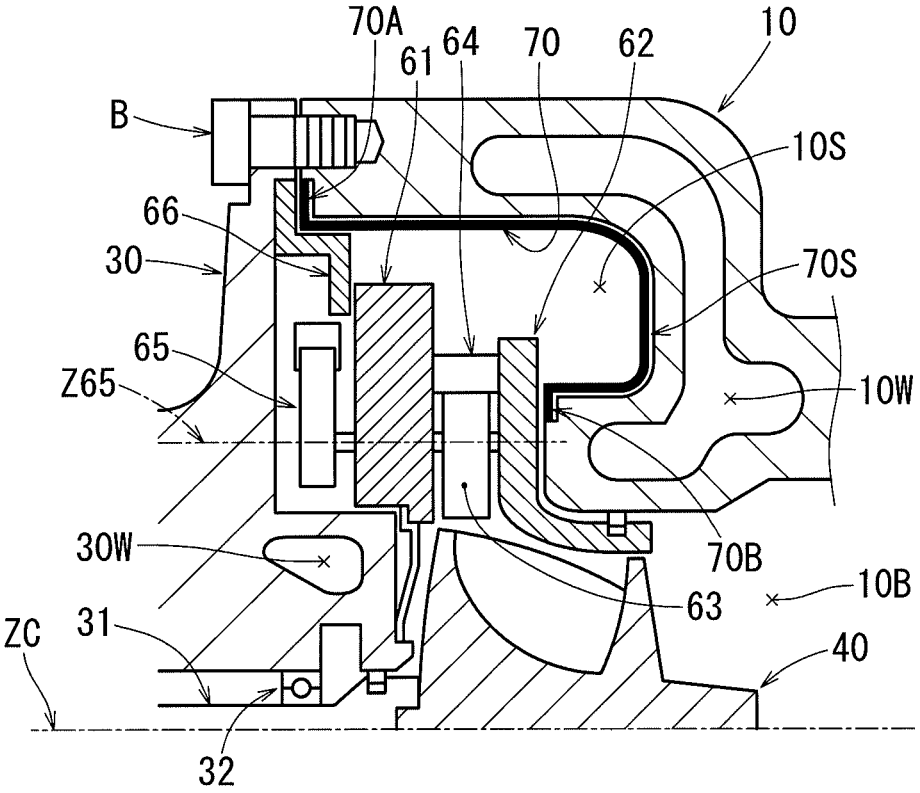
FIG. 5 is an enlarged cross-sectional view of a part of the turbocharger having an annular member.

As described above, the flow path may be formed as a substantially closed space by the heat shield plate 70, the first plate 61 and the second plate 62. Alternatively, the flow path may be formed as a substantially closed space in the manner as shown in FIG. 5. The structure shown in FIG. 5 has an annular member 66. The annular member 66 is held between the turbine housing 10 and the bearing housing 30. The annular member 66 is fixed to the turbine housing 10 to hold the first plate 61. The annular member 66, the heat shield plate 70, the first plate 61 and the second plate 62 form a substantially closed space.

As stated above, the turbocharger may be provided in a vehicle in which an internal combustion engine is mounted. Alternatively, the turbocharger may be applicable to various other uses. The fluid is not necessarily restricted to exhaust gas.

The above-mentioned values are only given by way of example, and should not be construed restrictively.

This invention claims:

1. A turbocharger comprising:

a turbine configured to be rotated by using energy caused by a fluid flowing into the turbocharger;

a turbine housing configured to accommodate the turbine, the turbine housing having a flow path for guiding the fluid to the turbine;

a plurality of variable valves configured to rotate about each pivot member provided thereon, thereby adjusting flow velocity of the fluid guided from the flow path to the turbine;

a first plate configured to support a first end of each pivot member of the variable valves;

a second plate arranged so that the variable valves are between the second plate and the first plate, the first plate and the second plate being configured to define the flow path;

a heat shield member configured to cover a wall surface of the turbine housing, wherein a gap is formed between the wall surface and the heat shield member, the heat shield member being configured to define the flow path, wherein the flow path is configured such that the fluid flowing into the turbocharger is guided between the first plate, the second plate, and the heat shield member, and to the turbine;

a rotation shaft of the turbine;

a bearing configured to rotatably support the rotation shaft; and a bearing housing configured to accommodate the rotation shaft and the bearing, the bearing housing being connected to the turbine housing, wherein the hearing housing is closer to the first plate than the second plate, and the second plate contacts with an inner wall of the turbine housing, and the heat shield member comprises a first end portion and a second end portion, wherein the first end portion is held between the turbine housing and the bearing housing or the second end portion is held between the turbine housing and the second plate.

2. The turbocharger of claim 1, wherein the first end portion of the heat shield member is held between the turbine housing and the bearing housing, and the second end portion of the heat shield member is held between the turbine housing and the second plate.

3. The turbocharger of claim 1, wherein the turbine housing comprises a discharge port to which the fluid is guided after rotating the turbine.

4. The turbocharger of claim 3 further comprising a discharge port heat shield member configured to cover at least a part of an inner wall of the discharge port.

5. The turbocharger of claim 4, wherein the discharge port heat shield member is of a tubular configuration.

6. The turbocharger of claim 3 further comprising a connection pipe connected to the discharge port, wherein the connection pipe comprises a discharge port heat shield member accommodated in the discharge port so that the discharge port heat shield member covers at least a part of an inner wall of the discharge port.

7. The turbocharger of claim 6, wherein the discharge port heat shield member is of a tubular configuration.

* * * * *